United States Patent [19]

Lapp

[11] 4,041,500

[45] Aug. 9, 1977

[54] LINE SCAN RADAR ANTENNA USING A SINGLE MOTOR

[75] Inventor: Roger H. Lapp, Silver Spring, Md.

[73] Assignee: The United States of America as represented by the Secretary of the Navy, Washington, D.C.

[21] Appl. No.: 685,866

[22] Filed: May 12, 1976

[51] Int. Cl.[2] ..... H01Q 3/12; H01Q 19/18

[52] U.S. Cl. ..... 343/761; 343/766; 343/781 P

[58] Field of Search ..... 343/761, 763, 765, 766, 343/839, 781 P

[56] References Cited

U.S. PATENT DOCUMENTS

| | | | |
|---|---|---|---|
| 2,855,521 | 10/1958 | Blackstone | 343/840 |
| 3,392.397 | 7/1968 | Schwartz | 343/761 |

*Primary Examiner*—Eli Lieberman

[57] ABSTRACT

According to the present invention, radar rays are reflected off a rotating secondary reflector which is both tilted with respect to and synchronously translated, in simple harmonic motion, in a direction transverse to the axis of rotation of the secondary reflector. The combined effect of the tilting and translating of the secondary reflector is to produce a line scan when the rays from the secondary reflector are reflected off a primary reflector.

10 Claims, 9 Drawing Figures

LINE SCAN RADAR ANTENNA USING A SINGLE MOTOR

BACKGROUND OF THE INVENTION

In the past, rotating mirror systems of various types were used in radar scanning applications. Some such systems have comprised reflectors combined with synchronized motors, strobes and/or encoder elements which often resulted in power losses or inefficiency. Still other prior art systems have employed separate oscillator means of the torsional type which have used electrical pick-ups, photocells, phase detectors, and the like for producing radar scan.

The prior art systems, because of their losses, complexity, and synchronization needs, have been less than effective in environments subject to high vibration levels, such as in helicopters and the like.

SUMMARY OF THE INVENTION

The present invention avoids the disadvantages of the prior art by using a single motor to produce a plurality of effects, namely rotating in a tilted fashion and synchronously translating in simple harmonic motion a secondary reflector, to achieve a line scan.

The present invention is capable of operating with radar at high frequencies, such as 95 MHz, without the need for synchronization, phase detection, or electrically monitoring the frequency of a separate scan oscillator.

The present invention provides a simple mechanical apparatus for producing a line scan by employing only a motor and an adjustable imbalance.

The present invention, because of its simple mechanical nature, can be used effectively at high scan rates in high vibration environments, such as helicopters.

DESCRIPTION OF THE PREFERRED EMBODIMENT

Figure 1:
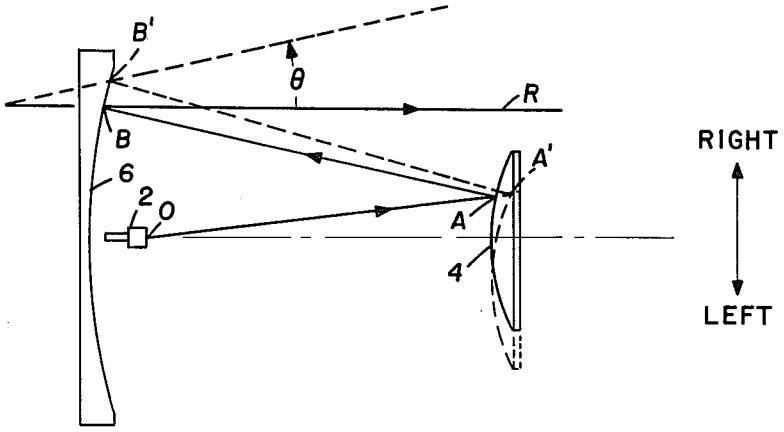
FIG. 1 is a simplified diagram showing the effect, on a sample radar ray, of translating the secondary reflecctor of the present invention.
Figure 2:
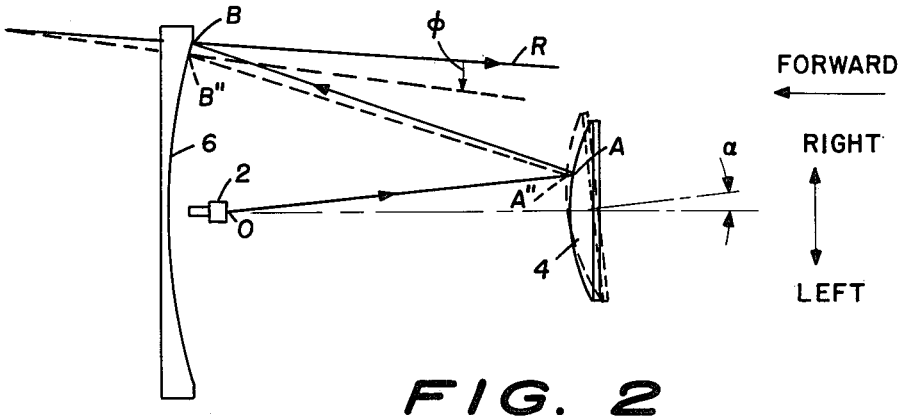
FIG. 2 is a simplified diagram showing the effect, on a sample radar ray, of tilting the secondary reflector of the present invention.
Figure 3:
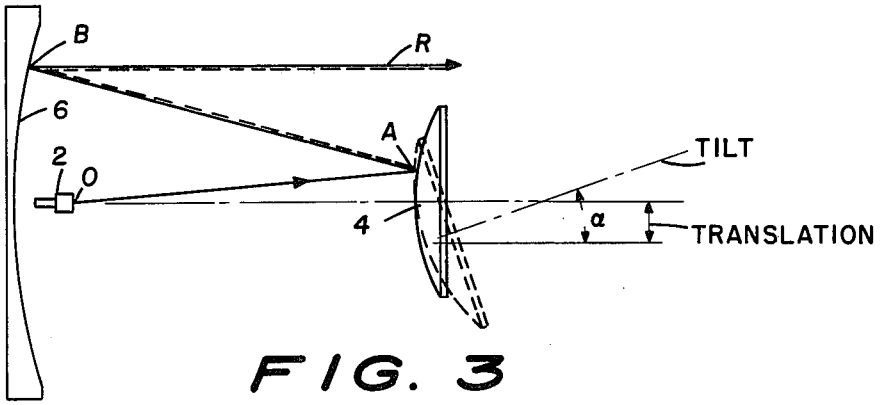
FIG. 3 is a simplified diagram showing the combined effects on the sample radar ray of tilting and translating the secondary reflector of the present invention.

For purposes of explanation a reference ray R is shown in FIG. 1, FIG. 2, and FIG. 3. Reference ray R emanates from a source 2 at point 0 and is reflected off a secondary reflector 4 at point A. From secondary reflector 4, reference ray R is directed towards a primary reflector 6 striking primary reflector 6 at point B. Reference ray R is then reflected off primary reflector 6 and out into space. Reference ray R shows how a ray directed along the line OA from source 2 will be reflected when secondary reflector 4 is neither translated nor tilted.

Referring now to only FIG. 1, reflector 4 is also shown in a translated position (in dash-line representation). With secondary reflector 4 translated, the ray from source 2 strikes the translated secondary reflector 4 at point A'. From point A' the ray is reflected off secondary reflector 4 onto primary reflector 6 at point B'. The ray then reflected off primary reflector 6 is then reflected out into space at a variable angle $\phi$ with respect to reference ray R. This effect, of course, is an illustration of the principle that the incident angle is equal to the reflected angle of a reflected ray. By translating secondary reflector 4 to the left (see the accompanying reference symbol in FIG. 1), an incoming ray from source 2 directed along OA will be reflected to the right of reference ray R. Similarly, but not shown, translating secondary reflector 4 to the right would produce a ray moving to the left of reference ray R. By periodically translating secondary reflector 4 from the right to the left and back to the right again, a corresponding movement of the outgoing ray from the left to the right and to the left again is produced.

Referring now to FIG. 2, the effect of tilting secondary reflector 4 by an angle $\alpha$, shown in dash-line, with respect to the original (solid line) reference positionof secondary reflector 4, will now be described. As in FIG. 1, reference ray R is shown emanating from source 2 along line OA, reflecting off secondary reflector 4 (in its reference position) towards point B on primary reflector 6, and reflecting off primary reflector 6 out into space. After tilting secondary reflector 4 by an angle $\alpha$ with respect to the reference position of secondary reflector 4, the ray from source 2 strikes the tilted secondary reflector at point A''. The angle of incidence being equal to the angle of reflection, the ray reflected off secondary reflector 4 strikes primary reflector 6 at point B''. The outgoing ray reflected off primary reflector 6 is directed into space at a variable angle $\phi$ with respect to reference ray R. It is apparent from FIG. 2 that by tilting secondary reflector 4 forward on the right side (as oriented in the figure) the outgoing ray reflected off primary reflector 6 is directed to the left of reference ray R by an amount related to but not necessarily equal to the angle $\alpha$. Similarly (but not shown in the figure), by tilting secondary reflector 4 forward to the left with respect to the reference position of secondary reflector 4, the outgoing ray can be reflected to the right of reference ray R by variable angle $\phi$. By properly selecting tilt angle $\alpha$, variable angle $\phi$ defined between reference ray R and the outgoing ray from point B'' can be made equal and opposite to a given angle $\theta$ (the angle resulting from the translation effect shown in FIG. 1) or, alternatively, angle $\theta$ may be selected or adjusted, as will be shown later, to correspond to a given variable angle $\theta$.

By examining FIG. 1 and FIG. 2 together it can be seen that, at any given time, angle $\theta$ (resulting from the translation of secondary reflector 4) can be selected to cancel the effect caused by tilting secondary reflector 4. Simply stated, while the ray is directed to the left by an angle $\theta$ due to the tilting of secondary reflector 4 as shown in FIG. 2, the outgoing ray in FIG. 1 is, at the same time, directed to the right of reference ray R by an equl but opposite angle $\theta$ due to the translation of secondary reflector 4 as shown in FIG. 1. The two effects combine to cancel each other, thereby producing reference ray R as the combined-effect outgoing ray. The combined effect of tilting and translating secondary reflector 4 is shown in FIG. 3.

Figure 4:
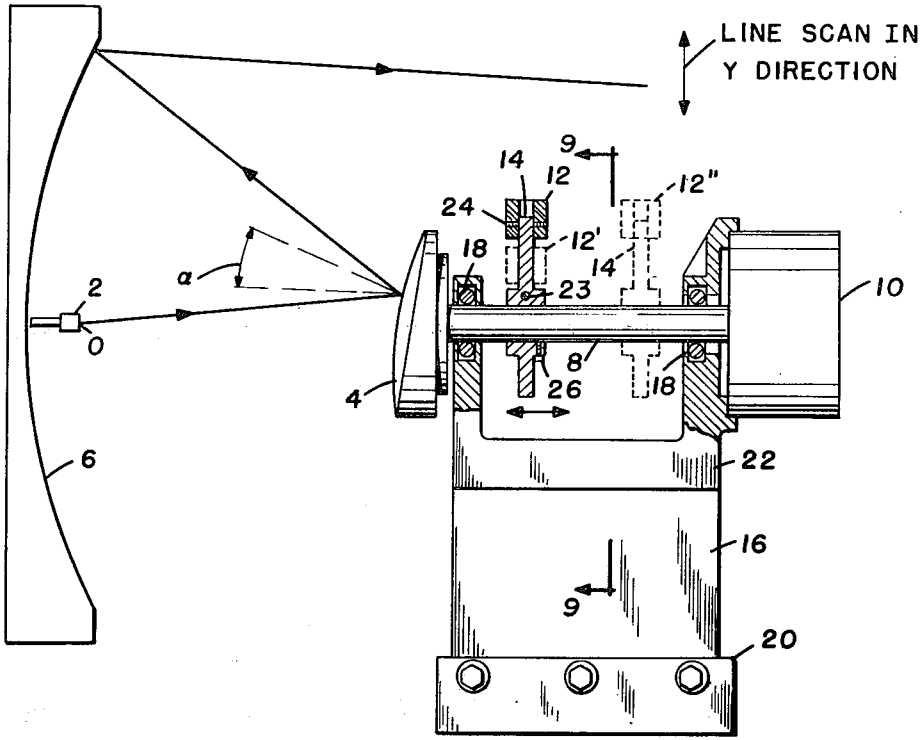
FIG. 4 is a front view illustration of the line scan apparatus of the present invention.
Figure 9:
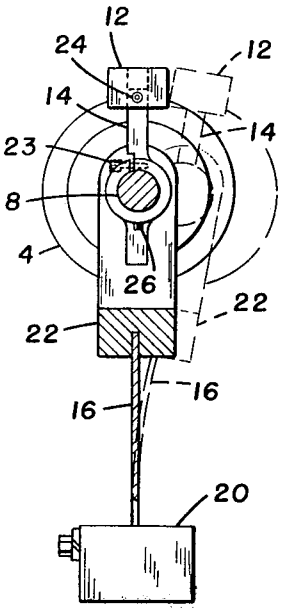
FIG. 9 shows a side view of the present invention.
Figure 5:
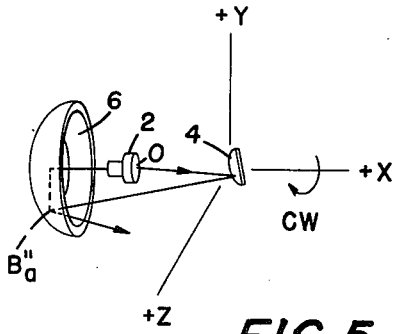
FIGS. 5 through 8 are simplified diagrams showing the tilting effect in three dimensions (X, Y, Z).
Figure 6:
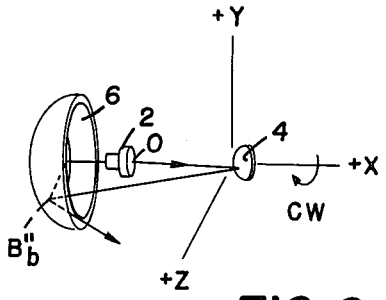
Figure 8:
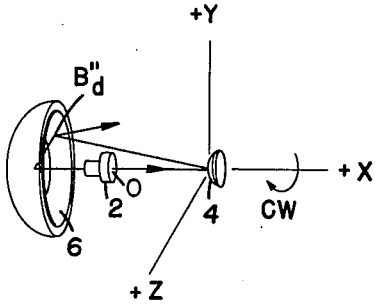
Figure 7:
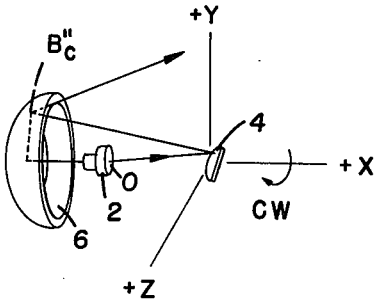

Referring now to FIG. 4 the apparatus which achieves a cancellation of both effects in one dimension will now be described. Secondary reflector 4 is shown affixed to a shaft 8 of a motor 10, such that the angle formed between the axis of symmetry of the secondary reflector 4 and the axis of shaft 8 form angle $\alpha$. As shaft 8 rotates clockwise (CW) in the present embodiment, secondary reflector 4 is caused to rotate in a "tilted" fashion. Reference is now made to FIGS. 5 through 8 which illustrate, in three dimensions (X, Y, Z), the nutation effect which results when secondary reflector 4 is rotated clockwise in tilted fashion. In FIG. 5, secondary reflector 4 is shown tilted forward on the positive Y side. This causes a ray along line OA to be reflected off secondary reflector 4 in the negative Y direction. In FIG. 6, secondary reflector 4 is titled forward on the negative Z side, thereby causing a ray from source 2 along line OA to be reflected off secondary reflector 4 in the positive Z direction. Similarly, in FIG. 7, a tilting forward of reflector 4 causes a ray from source 2 along line OA to be reflected in the positive Y direction. Lastly, in FIG. 8 as secondary reflector 4 continues to rotate in a clockwise fashion it tilts forward on the positive Z side, thereby causing a ray from source 2 along line OA to be reflected in the negative Z direction as shown. The overall effect of the tilting coupled with the rotation of secondary reflector 4 is nutation of the bundle of radar rays. Referring again to FIG. 4, a weight 12 is shown attached to shaft 8 by means of an attaching member. As shaft 8 rotates (when motor 10 is running), weight 12 creates an imbalance. This imbalance is transferred to a flat spring 16 by means of a bearing assembly 18 which operably couples flat spring 16 to shaft 8. One end of flat spring 16 is attached to immovable member 20 while the other end is attached to frame piece 22. This arrangement permits shaft 8 to rotate freely and also permits flat spring 16 to flex and thereby cause shaft 8 to translate transversely to the direction of the shaft axis (into or out of the page). The flexing of flat spring 16 is produced by the imbalancing effect of rotating weight 12. As weight 12 rotates, flat spring 16 flexes (into the page) and then re-flexes (out of the page) in a simple harmonic oscillating fashion. As flat spring 16 flexes and re-flexes, secondary reflector 4 is translated, thereby producing the aforementioned angular displacement $\theta$. By the proper placement of weight 12, $\theta$ can be made equal and opposite to the component of variable angle $\phi$ in one dimension. For $\theta$ and $\phi$, (both of which move in simple harmonic fashion) to cancel each other exactly, it is necessary that they be 180° out of phase. To provide an adjustment of the phase difference, counterweight 12 and attaching member 14 are made rotatable about shaft 8 and lockable to shaft 8 by means of lock means 23 (shown in FIGS. 4 and 9). For example, with variable angle $\theta$ being measured in the XZ plane, weight 12 can be positioned such that the component of variable angle $\phi$ in the XZ plane is cancelled. A line scan, LS, results in the vertical Y direction as illustrated in FIG. 4.

Two adjustment controls are provided for positioning weight 12 so as to achieve the proper flexion and reflexion of flat spring 16. First, a radial adjustment means 24 is provided which allows weight 12 to be moved radially toward (shown by 12') or away from the shaft 8 along member 14. The further from shaft 8 weight 12 is located, the larger the imbalance caused and the greater the flexion of flat spring 16. This will, then, cause shaft 8 to translate a longer distance. Radial adjustment means 24 may be considered an adjustment of the magnitude of translation. To achieve purity of translation the plane of rotation of the unbalanced force, i.e., weight 12, must contain the center of gravity of the moving mass (which includes weight 12, shaft 8, and member 14) and must act through the line of symmetry of flat spring 16. Axial adjustment means 26 which permits weight 12 to be slid along shaft 8 to a new position shown by the dotted weight assembly 12'' is thus provided. Axial adjustment means 26 controls the purity of translation by adjusting and eliminating unwanted torsional flexing of flat spring 16 about its Y axis. In the preferred embodiment, axial adjustment-means 26 would eliminate torque components which do not translate shaft 8 in a direction transverse to the shaft axis. (In FIG. 1, the effect may be viewed as translating the shaft uniformly into and out of the page). Radial adjustment means 24 and axial adjustment means 26 can be of the collar, clamp, set screw, magnet, or similar type. It should, however, be noted that the tilting and translating of secondary reflector 4 can produce coma and aberrations if the present invention is used beyond certain line scan amplitude limits. The amplitude of the line scan achievable is dependent upon the design tolerance to aberrations and to modulations on side-lobes.

From the foregoing it is clear that a number of conditions should be present to accomplish the line scan according to the invention. First, in the preferred embodiment, the flat spring 16 is chosen to run at resonant frequency, resulting in simple harmonic, synchronous translation of shaft 8. Although not necessary, this feature facilitates smooth, uniform scanning. This is accomplished by proper selection of flat spring 16 and weight 12, and by proper adjustment of weight 12 radially, rotationally, and axially with respect to shaft 8. Second, the effect of nutation and the effect of translation should be equal and opposite in one dimension (for example, in the horizontal dimension for a vertical line scan). Third, flat spring 16 should be made to flex without twisting (which would cause an open scan or a figure-8 scan) by axially adjusting weight 14.

The final effect of the present apparatus is that transmitted radar rays reflected off a rotating, translating, tilted secondary reflector 4 and then reflected off a primary reflector 6 are formed into an output ray bundle which forms a one-dimensional line scan.

Obviously, various modifications, adaptations and alterations are possible in light of the above teachings without in any manner departing from the spirit or scope of the present invention, as defined in the appended claims.

What is claimed is:

1. A line scan radar antenna comprising:

a secondary reflector, a motor, a shaft coupling the motor to the secondary reflector, the axis of the shaft forming an angle $\alpha$ with the axis of symmetry of the secondary reflector, means affixed to the shaft for translating the shaft in a direction transverse to the axis of the shaft in response to the rotation of the motor and secondary reflector, and a primary reflector which receives radar rays reflected off the secondary reflector and reflects them in a line scan.

2. A line scan radar antenna as defined in claim 1, wherein the translating means comprises:

a weight attached to the shaft and a flat spring operably coupled to the shaft such that rotation of the shaft with the attached weight periodically flexes and unflexes the flat spring.

3. A line scan radar antenna as defined in claim 2 further comprising:

an attaching member which attaches the weight to the shaft, radial adjustment means operably connected to the weight and the attaching member, permitting the weight to be moved radially toward and away from the shaft, axial adjustment means connected to the attaching member and the shaft, permitting the attaching member with the attached weight to be moved axially along the shaft, and phase difference adjustment means connected to the attaching member and the shaft permitting the weight and attaching member to be adjusted in rotational position with respect to the secondary reflector.

4. A line scan radar antenna as define in claim 3, wherein:

the radial adjustment means comprises a collar means affixed to said weight, said means being slidable and stoppable along the attaching member, and the axial adjustment means comprises a set screw arrangement slidable and stoppable along the shaft.

5. A line scan radar antenna as defined in claim 1 wherein the secondary reflector and primary reflector are curved.

6. A line scan radar antenna as defined in claim 1 wherein said translating means is affixed to the shaft so that said transverse direction is horizontal.

7. A method of line scanning a radar antenna comprising the steps:

rotating the shaft of a motor, affixing a secondary reflector to the end of the shaft, tilting the axis of symmetry of the secondary reflector to an angle $\alpha$ with the axis of the shaft, translating the secondary reflector in oscillatory fashion in a direction transverse to the direction of the shaft axis, synchronizing the secondary reflector translation with the shaft rotation, reflecting a radar ray off the tilted, rotating secondary reflector, to obtain a reflector ray which scans in a direction perpendicular to the transverse direction, limiting the amount of translation to that required to cancel the angular displacement of the radar ray in the direction transverse to the shaft axis due to the tilt of the secondary reflector, reflecting the ray from the secondary reflector into a primary reflector, and reflecting a line scan pattern from the primary reflector.

8. A method of line scanning a radar antenna as defined in claim 7 wherein the translation of the secondary reflector comprises the steps:

attaching a weight to the rotating shaft, coupling a flat spring to the shaft, flexing the flat spring in response to the rotational position of the attached weight, and translating the shaft and affixed secondary reflector in a direction transverse to the shaft axis in response to the flexion of the flat spring.

9. A method of line scanning a radar antenna as defined in claim 8, comprising the further steps:

positioning the direction of the transverse to the shaft axis to be horizontal, and orienting the primary reflector and secondary reflector to produce a vertical line scan.

10. A method of line scanning a radar antenna as defined in claim 8, comprising the further steps:

selectively moving the weight radially toward and away from the shaft to control the magnitude of flat spring flexion and thus the magnitude of translation of the secondary reflector, and sliding the weight axially along the shaft to control the torsional flexion of the flat spring and adjusting the weight in rotational position about the shaft to control the phase of translation of the flat spring.

* * * * *